US008269419B2

(12) United States Patent
Naoi et al.

(10) Patent No.: US 8,269,419 B2
(45) Date of Patent: Sep. 18, 2012

(54) PLASMA DISPLAY PANEL HAVING AN MGO CRYSTAL LAYER FOR IMPROVED DISCHARGE CHARACTERISTICS AND METHOD OF MANUFACTURING SAME

(75) Inventors: Taro Naoi, Yamanashi (JP); Hai Lin, Yamanashi (JP); Eishiro Otani, Yamanashi (JP); Hiroshi Ito, Yamanashi (JP)

(73) Assignee: Panasonic Corporation, Kadoma-shi, Osaka (JP)

( * ) Notice: Subject to any disclaimer, the term of this patent is extended or adjusted under 35 U.S.C. 154(b) by 0 days.

(21) Appl. No.: 13/137,033

(22) Filed: Jul. 15, 2011

(65) Prior Publication Data

US 2011/0309740 A1 Dec. 22, 2011

Related U.S. Application Data

(63) Continuation of application No. 12/662,768, filed on May 3, 2010, now Pat. No. 8,076,851, which is a continuation of application No. 11/283,514, filed on Nov. 21, 2005, now Pat. No. 7,759,868.

(30) Foreign Application Priority Data

Nov. 22, 2004 (JP) ..... 2004-337665

(51) Int. Cl.
*H01J 17/49* (2012.01)
*G09G 3/10* (2006.01)

(52) U.S. Cl. ..... 313/587; 313/582; 313/586; 345/41; 345/60; 345/71; 315/169.4

(58) Field of Classification Search ..... 313/581–587; 315/169.4; 345/37, 41, 60, 713
See application file for complete search history.

(56) References Cited

U.S. PATENT DOCUMENTS

| | | | |
|---|---|---|---|
| 6,788,373 | B2 | 9/2004 | Ito et al. |
| 7,535,178 | B2 | 5/2009 | Ushizawa et al. |
| 7,626,336 | B2 | 12/2009 | Hai et al. |
| 8,120,254 | B2 | 2/2012 | Aoto et al. |
| 8,120,255 | B2 | 2/2012 | Kawarazaki et al. |
| 8,143,786 | B2 | 3/2012 | Sakamoto et al. |
| 8,148,899 | B2 | 4/2012 | Maeshima et al. |
| 8,154,204 | B2 | 4/2012 | Mizokami et al. |

(Continued)

FOREIGN PATENT DOCUMENTS

EP 1 580 786 A2 9/2005

(Continued)

OTHER PUBLICATIONS

Miyashita, et al., Japanese Patent Application No. 2002-150953, May 2002, machine translation.

(Continued)

*Primary Examiner* — Anne Hines
*Assistant Examiner* — Tracie Y Green
(74) *Attorney, Agent, or Firm* — McGinn IP Law Group, PLLC

(57) ABSTRACT

A plasma display panel equipped with a front substrate and a back substrate facing each other to form a discharge space. On the discharge space side of the front substrate there are disposed a metal oxide layer and magnesium oxide crystal particles. An area ratio of the magnesium oxide crystal particles to the metal oxide layer is 0.1% to 85%.

9 Claims, 10 Drawing Sheets

U.S. PATENT DOCUMENTS

| | | | | |
|---|---|---|---|---|
| 8,164,262 | B2 | 4/2012 | Shiokawa et al. | |
| 2003/0067269 | A1 | 4/2003 | Mitamura et al. | |
| 2004/0075388 | A1* | 4/2004 | Miyashita et al. | 313/586 |
| 2005/0082982 | A1 | 4/2005 | Kim | |
| 2005/0206318 | A1 | 9/2005 | Hirota et al. | |
| 2006/0261738 | A1 | 11/2006 | Ohtoh et al. | |
| 2007/0013306 | A1 | 1/2007 | Hai et al. | |
| 2007/0210712 | A1 | 9/2007 | Miyata et al. | |
| 2007/0228980 | A1 | 10/2007 | Miyata et al. | |
| 2010/0102722 | A1 | 4/2010 | Mizokami et al. | |
| 2011/0309740 | A1 | 12/2011 | Naoi et al. | |
| 2011/0309741 | A1* | 12/2011 | Naoi et al. | 313/587 |
| 2011/0309742 | A1* | 12/2011 | Naoi et al. | 313/587 |
| 2011/0309743 | A1* | 12/2011 | Naoi et al. | 313/587 |
| 2012/0070616 | A1* | 3/2012 | Naoi et al. | 428/143 |

FOREIGN PATENT DOCUMENTS

| | | | |
|---|---|---|---|
| EP | 1 600 921 | A2 | 11/2005 |
| EP | 1 638 127 | A2 | 3/2006 |
| EP | 1 657 735 | A2 | 5/2006 |
| JP | 6-325696 | | 11/1994 |
| JP | 7-192630 | A | 7/1995 |
| JP | 7-230766 | A | 8/1995 |
| JP | 8-153470 | A | 6/1996 |
| JP | 10-125237 | A | 5/1998 |
| JP | 11-213869 | A | 8/1999 |
| JP | 2000-273644 | A | 10/2000 |
| JP | 2001-357787 | A | 12/2001 |
| JP | 2002-33053 | A | 1/2002 |
| JP | 2002-56773 | | 2/2002 |
| JP | 2002-150953 | A | 5/2002 |
| JP | 2007-035655 | A | 2/2007 |
| KR | 10-2011-0031508 | A | 3/2011 |
| WO | WO 2004/053914 | A1 | 6/2004 |

OTHER PUBLICATIONS

European Search Report dated Sep. 18, 2007.

Japanese Office Action dated Jun. 1, 2010, with English language translation.

First Action Interview Pilot Program Pre-Interview Communication in U.S. Appl. No. 13/137,037 dated Dec. 15, 2011.

First Action Interview Pilot Program Pre-Interview Communication in U.S. Appl. No. 13/137,034 dated Dec. 16, 2011.

Office Action in U.S. Appl. No. 13/137,035 dated Nov. 28, 2011.

Office Action in U.S. Appl. No. 13/137,035, dated Apr. 30, 2012.

Notice of Allowance in U.S. Appl. No. 13/137,034, dated Apr. 27, 2012.

Office Action in U.S. Appl. No. 13/306,704, dated Mar. 12, 2012.

Notice of Allowance in U.S. Appl. No. 13/137,037, dated Apr. 13, 2012.

Office Action dated Jul. 2, 2012, in co-pending U.S. Appl. No. 13/306,704.

* cited by examiner

EMBODIMENT

SECTION V-V

SECTION W-W

SINGLE CRYSTAL OF CUBIC
SINGLE - CRYSTAL STRUCTURE

SINGLE CRYSTALLINE MgO OF CUBIC POLYCRYSTAL STRUCTURE

PLASMA DISPLAY PANEL HAVING AN MGO CRYSTAL LAYER FOR IMPROVED DISCHARGE CHARACTERISTICS AND METHOD OF MANUFACTURING SAME

The present Application is a Continuation Application of U.S. patent application Ser. No. 12/662,768, filed on May 3, 2010 now U.S. Pat. No. 8,076,851 which is a Continuation Application of U.S. patent application Ser. No. 11/283,514, filed on Nov. 21, 2005, now U.S. Pat. No. 7,759,868, the entirety of each of which are incorporated herein by reference.

The present application claims priority from Japanese Application No. 2004-337665, the disclosure of which is incorporated herein by reference.

BACKGROUND OF THE INVENTION

1. Field of the Invention

This invention relates to a structure of plasma display panels and a method of manufacturing the plasma display panels.

2. Description of the Related Art

A surface-discharge-type alternating-current plasma display panel (hereinafter referred to as "PDP") has two opposing glass substrates placed on either side of a discharge-gas-filled discharge space. On one of the two glass substrates, row electrode pairs extending in the row direction are regularly arranged in the column direction. On the other glass substrate, column electrodes extending in the column direction are regularly arranged in the row direction. Unit light emission areas (discharge cells) are formed in matrix form in positions corresponding to the intersections between the row electrode pairs and the column electrodes in the discharge space.

The PDP further has a dielectric layer provided for covering the row electrodes or the column electrodes. A magnesium oxide (MgO) film is formed on a portion of the dielectric layer facing each of the unit light emission areas. The MgO film has the function of protecting the dielectric layer and the function of emitting secondary electrons into the Unit light emission area.

As a method of forming the magnesium oxide film in the manufacturing process for the PDP as described above, the use of a screen printing technique of coating a paste containing magnesium oxide powder on the dielectric layer to form a magnesium oxide film has been considered for adoption in terms of simplicity and convenience.

Such a conventional method of forming the magnesium oxide film is disclosed in Japanese Patent Laid-open Publication No. H6-325696, for example.

However, the discharge characteristics of a PDP having a magnesium oxide formed by a screen printing technique using a paste containing a polycrystalline floccules type magnesium oxide refined by heat-treating magnesium hydroxide is merely of an extent equal to or slightly greater than that of a PDP having a magnesium oxide film formed by the use of evaporation technique.

A need arising from this is to form a magnesium oxide film (i.e. a protective film) capable of yielding a greater improvement in the discharge characteristics in the PDP.

SUMMARY OF THE INVENTION

It is an object of the present invention to solve the problem associated with conventional PDPs having a magnesium oxide film formed therein as described above.

To attain this object, a plasma display panel according to an aspect of the present invention, which is equipped with a front substrate and a back substrate which face each other on either side of a discharge space, row electrode pairs and column electrodes which are provided between the front substrate and the back substrate and form unit light emission areas at intersections with each other in the discharge space, and a dielectric layer covering the row electrode pairs, comprises a crystalline magnesium oxide layer that includes crystal powder having particle-size distribution in which a crystal of a predetermined particle diameter or larger is included at a predetermined ratio or higher, of powder of a magnesium oxide crystal causing a cathode-luminescence emission having a peak within a wavelength range of 200 nm to 300 nm upon excitation by an electron beam, and that is provided in an area facing the discharge space between the front substrate and the back substrate.

To attain the above object, according another aspect of the present invention, a method of manufacturing a plasma display panel having a front substrate and a back substrate which face each other on either side of a discharge space, row electrode pairs and column electrodes which are provided between the front substrate and the back substrate and form unit light emission areas at intersections with each other in the discharge space, a dielectric layer covering the row electrode pairs, and a magnesium oxide layer formed in an area facing the discharge space, comprises a process of forming the magnesium oxide layer. The process of forming the magnesium oxide layer includes: a classification process of separating crystal powder having particle-size distribution in which a crystal of a predetermined particle diameter or larger is included at a predetermined ratio or higher, from powder of a magnesium oxide crystal causing a cathode-luminescence emission having a peak within a wavelength range of 200 nm to 300 nm upon excitation by an electron beam; and a process of forming a crystalline magnesium oxide layer including the magnesium oxide crystal powder having undergone the classification process.

In an exemplary embodiment of the present invention, a PDP has a crystalline magnesium oxide layer placed facing a discharge space between a front glass substrate and a back glass substrate. The crystalline magnesium oxide layer is formed of crystal powder separated, by classification, from the magnesium oxide crystal powder causing a cathode-luminescence emission having a peak within a wavelength range of 200 nm to 300 nm upon excitation by an electron beam. The separated crystal powder has particle-size distribution in which a crystal of a predetermined particle diameter or larger is included at a predetermined ratio or higher. Further, in an exemplary embodiment of the present invention, a method of manufacturing a PDP includes a formation process of forming a crystalline magnesium oxide layer including a magnesium oxide crystal causing a cathode-luminescence emission having a peak within a wavelength range of 200 nm to 300 nm upon excitation by an electron beam. The formation process includes a classification process of separating crystal powder having particle-size distribution in which a crystal of a predetermined particle diameter or larger is included at a predetermined ratio or higher, from the powder of the magnesium oxide crystal.

In the PDP in the embodiments, because the crystalline magnesium oxide layer facing the discharge space includes the magnesium oxide crystal causing a cathode-luminescence emission having a peak within a wavelength range of 200 nm to 300 nm upon excitation by an electron beam, the discharge characteristics such as relating to discharge delay and discharge probability in the PDP is improved. Thus, it is possible for the PDP of the present invention to have satisfactory discharge characteristics. Further, because the powder of the magnesium oxide crystal forming the crystalline magnesium oxide layer undergoes the classification process in the manufacturing process for the PDP, the magnesium oxide crystal powder has the particle-size distribution in which a crystal of a predetermined particle diameter or larger is included at a predetermined ratio or higher. In consequence, various effects can be exerted: for example, a further significant improvement in discharge delay, a reduction in the range of variations in discharge delays, a reduction in discharge voltage, an improvement in luminous efficiency, and an increase in the reliability of the panel caused by a reduction in the degree of adsorption of the discharge gas.

These and other objects and features of the present invention will become more apparent from the following detailed description with reference to the accompanying drawings.

DETAILED DESCRIPTION OF THE PREFERRED EMBODIMENT

Figure 1:
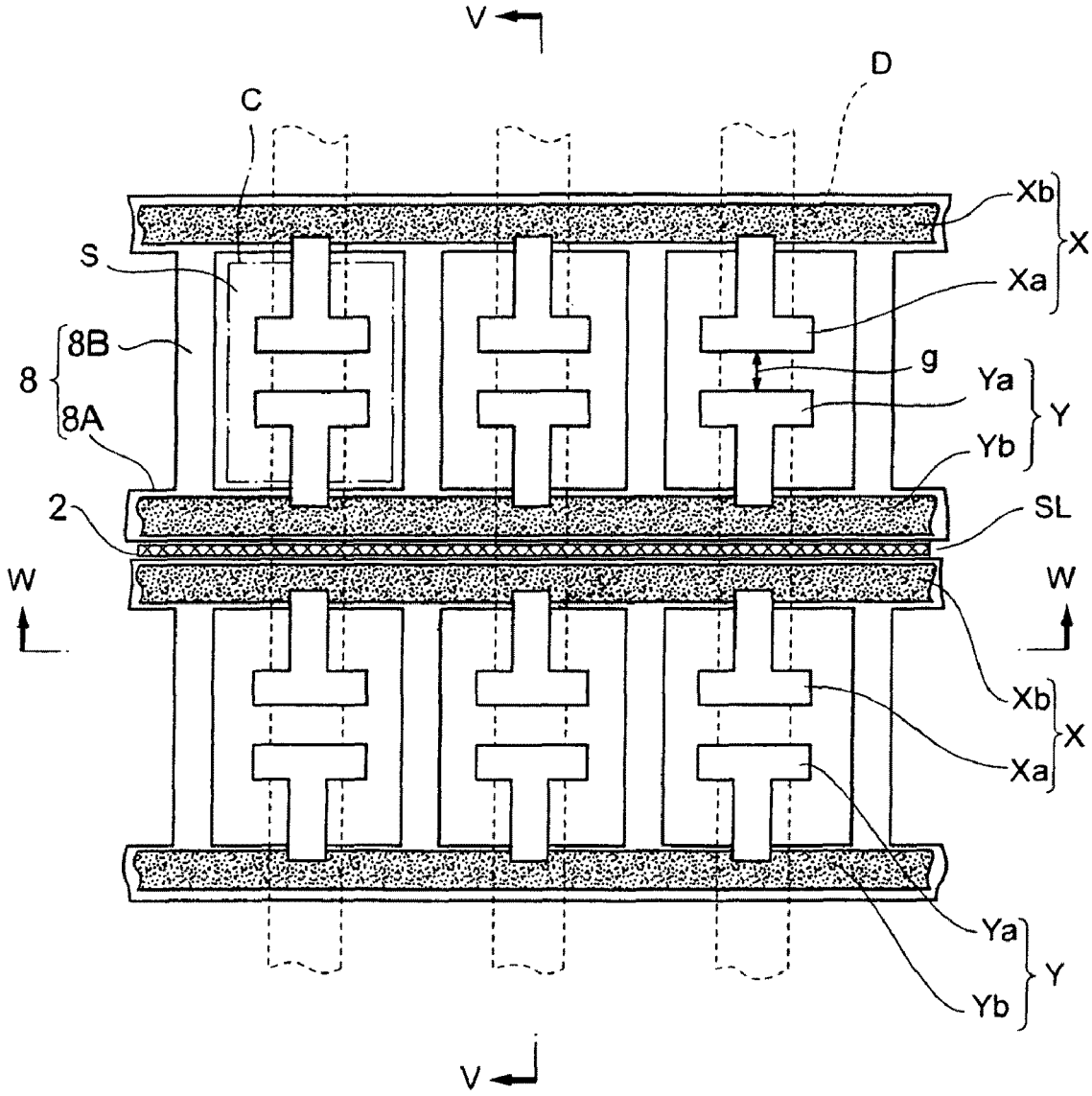
FIG. 1 is a front view illustrating an embodiment of the present invention.
Figure 2:
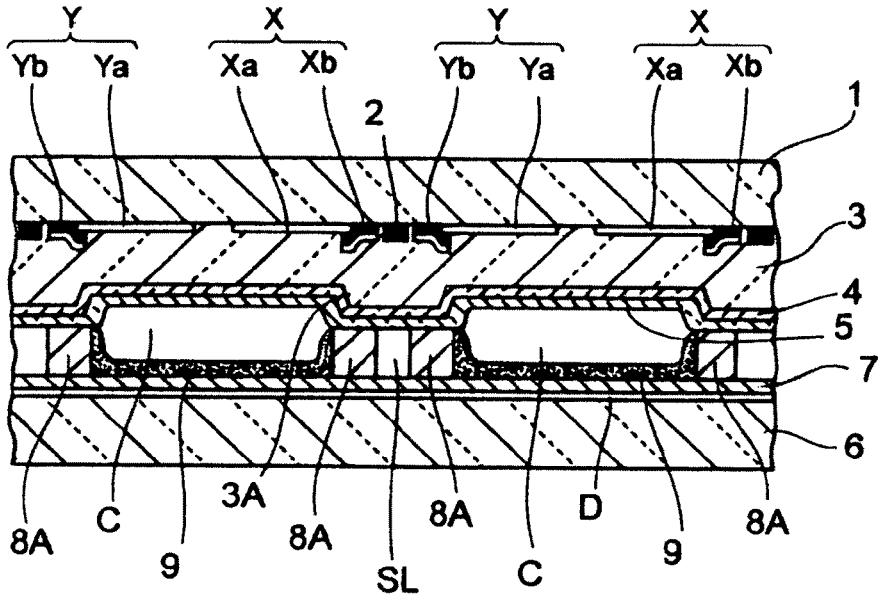
FIG. 2 is a sectional view taken along the V-V line in FIG. 1.
Figure 3:
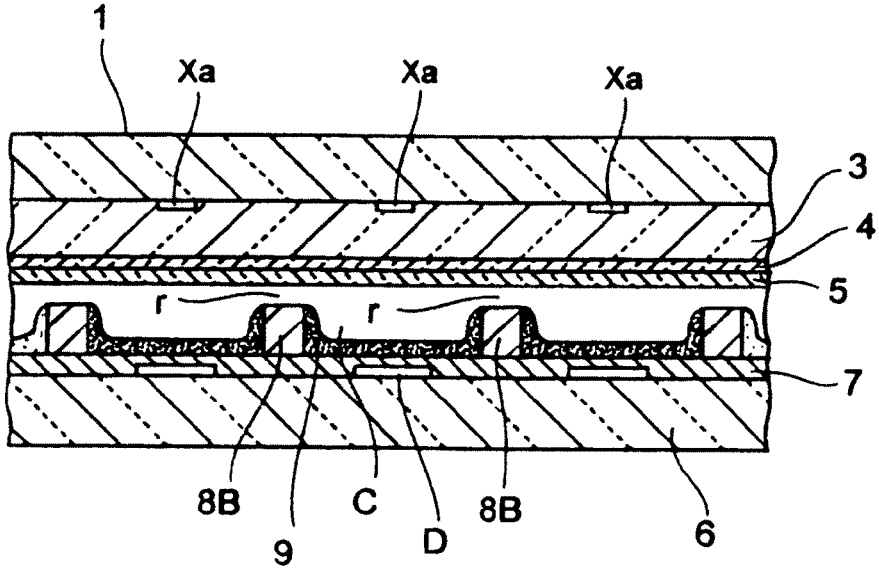
FIG. 3 is a sectional view taken along the W-W line in FIG. 1.

FIGS. 1 to 3 illustrate an embodiment of a PDP according to the present invention. FIG. 1 is a schematic front view of the PDP in the embodiment. FIG. 2 is a sectional view taken along the V-V line in FIG. 1. FIG. 3 is a sectional view taken along the W-W line in FIG. 1.

The PDP in FIGS. 1 to 3 has a plurality of row electrode pairs (X, Y) arranged in parallel on the rear-facing face (the face facing toward the rear of the PDP) of a front glass substrate 1 serving as a display surface. Each row electrode pair (X, Y) extends in a row direction of the front glass substrate 1 (the right-left direction in FIG. 1).

A row electrode X is composed of T-shaped transparent electrodes Xa formed of a transparent conductive film made of ITO or the like, and a bus electrode Xb formed of a metal film.

The bus electrode Xb extends in the row direction of the front glass substrate 1. The narrow proximal end (corresponding to the foot of the "T") of each transparent electrode Xa is connected to the bus electrode Xb.

Likewise, a row electrode Y is composed of T-shaped transparent electrodes Ya formed of a transparent conductive film made of ITO or the like, and a bus electrode Yb formed of a metal film. The bus electrode Yb extends in the row direction of the front glass substrate 1. The narrow proximal end of each transparent electrode Ya is connected to the bus electrode Yb.

The row electrodes X and Y are arranged in alternate positions in a column direction of the front glass substrate 1 (the vertical direction in FIG. 1). In each row electrode pair (X, Y), the transparent electrodes Xa and Ya are regularly spaced along the associated bus electrodes Xb and Yb and each extends out toward its counterpart in the row electrode pair, so that the wide distal ends (corresponding to the head of the "T") of the transparent electrodes Xa and Ya face each other on either side of a discharge gap g having a required width.

Black- or dark-colored light absorption layers (light-shield layers) 2 are further formed on the rear-facing face of the front glass substrate 1. Each of the light absorption layers 2 extends in the row direction along and between the back-to-back bus electrodes Xb and Yb of the row electrode pairs (X, Y) adjacent to each other in the column direction.

A dielectric layer 3 is formed on the rear-facing face of the front glass substrate 1 so as to cover the row electrode pairs (X, Y), and has additional dielectric layers 3A each formed on a portion of the rear-facing face thereof opposite to the back-to-back bus electrodes Xb, Yb of the adjacent row electrode pairs (X, Y) and to the area between the bus electrodes Xb, Yb. Each of the additional dielectric layers 3A projects from the dielectric layer 3 toward the rear of the PDP and extends in parallel to the back-to-back bus electrodes Xb, Yb.

The rear-facing faces of the dielectric layer 3 and the additional dielectric layers 3A are entirely covered by a magnesium oxide layer 4 of thin film (hereinafter referred to as "thin-film MgO layer 4") formed by vapor deposition or spattering.

A magnesium oxide layer 5 including a magnesium oxide crystal (hereinafter referred to as "crystalline MgO layer 5") is formed on the rear-facing face of the thin-film MgO layer 4. The magnesium oxide crystal included in the MgO layer 5 cause cathode-luminescence emission (hereinafter referred to as "CL emission") having a peak within a wavelength range from 200 nm to 300 nm (particularly, from 230 nm to 250 nm, around 235 nm) by being excited by an electron beam, as described later in detail.

The crystalline MgO layer 5 is formed on the entire rear face of the thin-film MgO layer 4 or a part of the rear face thereof, e.g. part facing each discharge cell described later (in the example shown in FIGS. 1 to 3, the crystalline MgO layer 5 is formed on the entire rear face of the thin-film MgO layer 4).

The front glass substrate 1 is parallel to a back glass substrate 6. Column electrodes D are arranged in parallel at predetermined intervals on the front-facing face (the face facing toward the display surface) of the back glass substrate 6. Each of the column electrodes D extends in a direction at right angles to the row electrode pair (X, Y) (i.e. the column direction) along a strip opposite to the paired transparent electrodes Xa and Ya of each row electrode pair (X, Y).

On the front-facing face of the back glass substrate 6, a white column-electrode protective layer (dielectric layer) 7 covers the column electrodes D and in turn, partition wall units 8 are formed on the column-electrode protective layer 7.

Each of the partition wall units 8 are formed in an approximate ladder shape made up of a pair of transverse walls 8A and a plurality of vertical walls 8B. The transverse walls 8A respectively extend in the row direction on portions of the column-electrode protective layer 7 opposite the bus electrodes Xb, Yb of each row electrode pair (X, Y). Each of the vertical walls 8B extends between the pair of transverse walls 8A in the column direction on a portion of the column-electrode protective layer 7 between the adjacent column electrodes D. The partition wall units 8 are regularly arranged in the column direction in such a manner as to form an interstice SL extending in the row direction between the back-to-back transverse walls 8A of the adjacent partition wall units 8.

Each of the ladder-shaped partition wall units 8 partitions the discharge space S defined between the front glass substrate 1 and the back glass substrate 6 into quadrangles to form discharge cells C each corresponding to the paired transparent electrodes Xa and Ya of each row electrode pair (X, Y).

In each discharge cell C, a phosphor layer 9 covers five faces: the side faces of the transverse walls 8A and the vertical walls 8B of the partition wall unit 8 and the face of the column-electrode protective layer 7. The three primary colors, red, green and blue, are individually applied to the phosphor layers 9 such that the red, green and blue discharge cells C are arranged in order in the row direction.

The crystalline MgO layer 5 covering the additional dielectric layers 3A (or the thin-film MgO layer 4 in the case where the crystalline MgO layer 5 is formed on each portion of the rear-facing face of the thin-film MgO layer 4 facing the discharge cell C) is in contact with the front-facing face of the transverse walls 8A of the partition wall unit 8 (see FIG. 2), so that each of the additional dielectric layers 3A blocks off the discharge cell C and the interstice SL from each other. However, the crystalline MgO layer 5 is out of contact with the front-facing face of the vertical walls 8B (see FIG. 3). As a result, a clearance r is formed between the crystalline MgO layer 5 and each of the vertical walls 8B, so that the adjacent discharge cells C in the row direction communicate with each other by means of the clearance r.

The discharge space S is filled with a discharge gas including xenon.

For the buildup of the crystalline MgO layer 5, a spraying technique, electrostatic coating technique or the like is used to cause the MgO crystal as described earlier to adhere to the rear-facing face of the thin-film MgO layer 4 covering the dielectric layer 3 and the additional dielectric layers 3A.

The embodiment describes the case of the crystalline MgO layer 5 being formed on the rear-facing face of the thin-film MgO layer 4 that has been formed on the rear-facing faces of the dielectric layer 3 and the additional dielectric layers 3A. However, a crystalline MgO layer 5 may be formed on the rear-facing faces of the dielectric layer 3 and the additional dielectric layers 3A and then a thin-film MgO layer 4 may be formed on the rear-facing face of the crystalline MgO layer 5.

Figure 4:
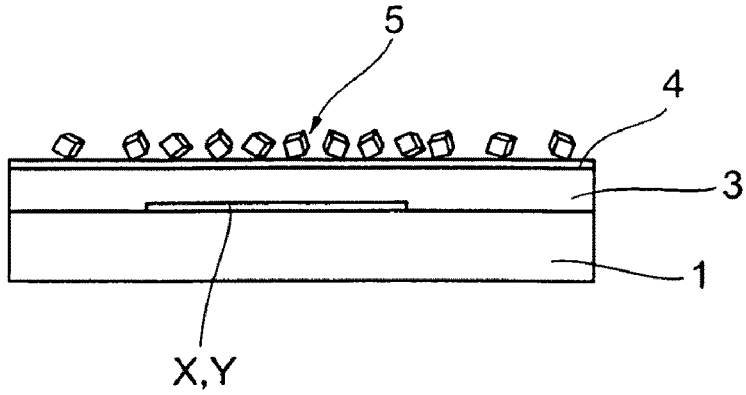
FIG. 4 is a sectional view showing the state of a crystalline magnesium oxide layer formed on a thin film magnesium layer in the embodiment.

FIG. 4 illustrates the state when the thin-film MgO layer 4 is first formed on the rear-facing face of the dielectric layer 3 and then an MgO crystal is affixed to the rear-facing face of the thin-film MgO layer 4 to form the crystalline MgO layer 5 by use of a spraying technique, electrostatic coating technique or the like.

Figure 5:
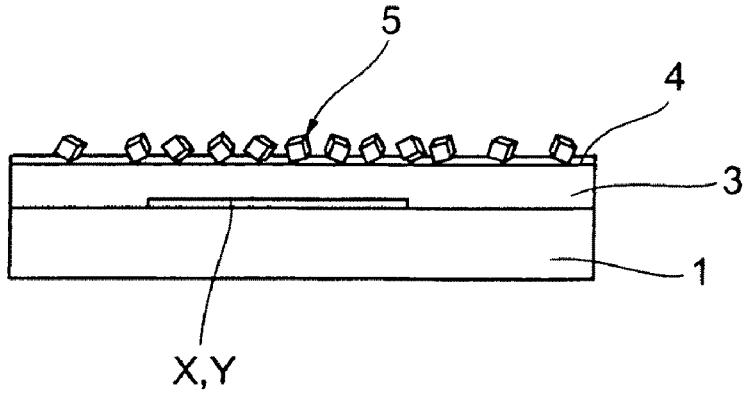
FIG. 5 is a sectional view showing the state of a thin film magnesium layer formed on a crystalline magnesium layer in the embodiment.

FIG. 5 illustrates the state when the MgO crystal is affixed to the rear-facing face of the dielectric layer 3 to form the crystalline MgO layer 5 by use of a spraying technique, electrostatic coating technique or the like, and then the thin-film MgO layer 4 is formed.

The crystalline MgO layer 5 of the PDP is formed by use of the following materials and method.

Figure 6:
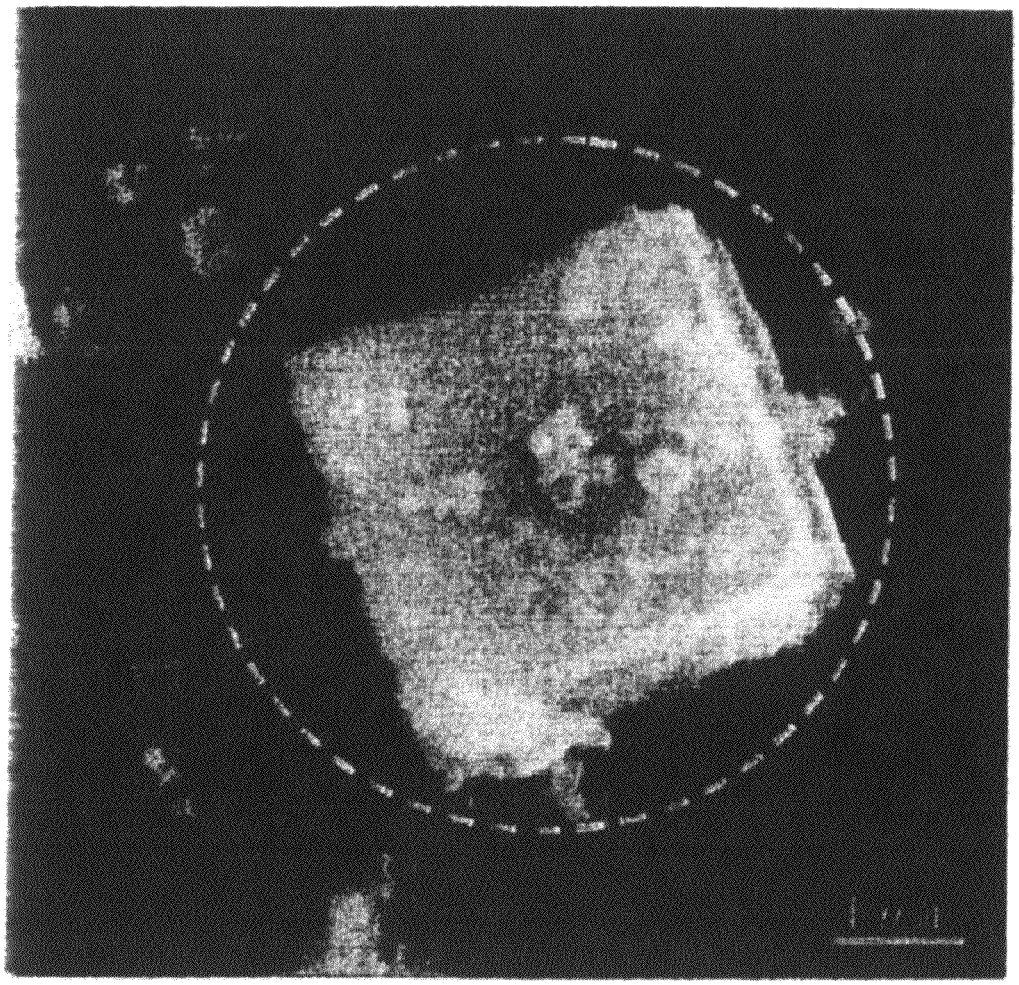
FIG. 6 is a SEM photograph of the magnesium oxide single crystal having a cubic single-crystal structure.
Figure 7:
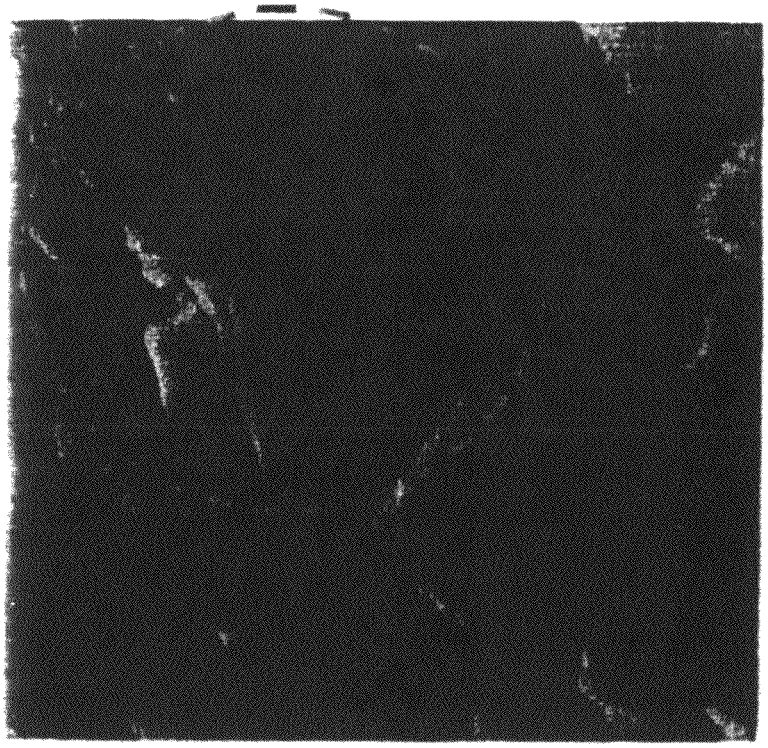
FIG. 7 is a SEM photograph of the magnesium oxide single crystal having a cubic polycrystal structure.

A MgO crystal, which is used as materials for forming the crystalline MgO layer 5 and causes CL emission having a peak within a wavelength range from 200 nm to 300 nm (particularly, from 230 nm to 250 nm, around 235 nm) by being excited by an electron beam, includes crystals such as a single crystal of magnesium obtained by performing vapor-phase oxidization on magnesium steam generated by heating magnesium (the single crystal of magnesium is hereinafter referred to as "vapor-phase MgO single crystal"). As the vapor-phase MgO single crystal are included an MgO single crystal having a cubic single crystal structure as illustrated in the SEM photograph in FIG. 6, and an MgO single crystal having a structure of a cubic crystal fitted to each other (i.e. a cubic polycrystal structure) as illustrated in the SEM photograph in FIG. 7, for example.

Crystal fine particles used for the MgO crystal forming the crystalline MgO layer 5 are classified for removal of crystal powder of small particle diameter so as to have particle-size distribution of equal to or larger than predetermined particle diameter.

Figure 8:
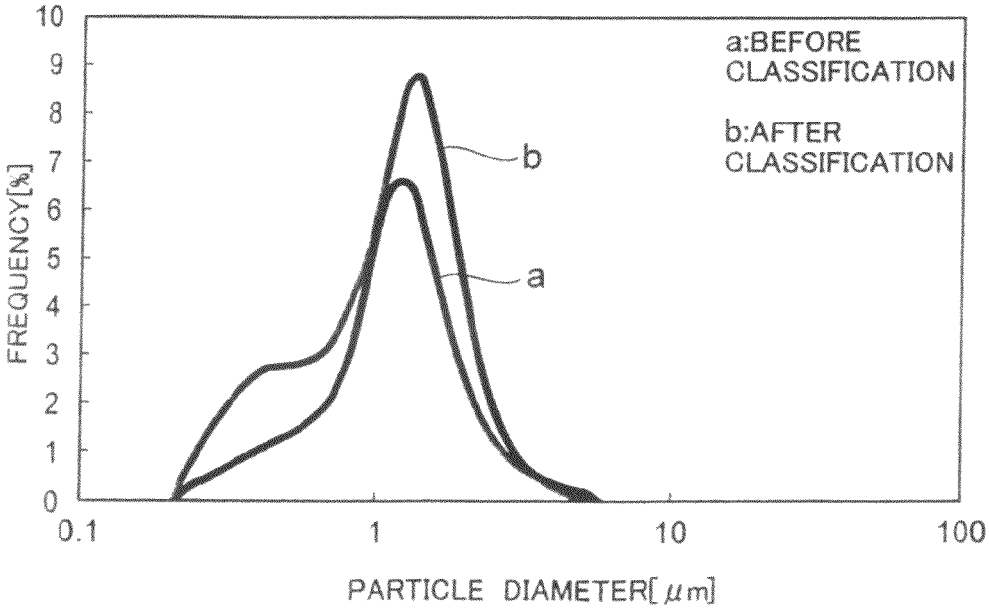
FIG. 8 is a graph showing particle-size distributions of classified magnesium-oxide crystal powder and unclassified magnesium-oxide crystal powder.

FIG. 8 shows the particle-size distributions of classified MgO crystal fine particles and unclassified MgO crystal fine particles in reference to volume. In FIG. 8, the graph a shows the particle-size distribution before the classification process and the graph b shows the particle-size distribution after the classification process.

In FIG. 8, the MgO crystal powder of particle diameter 0.7 μm or less is 31.6% in the particle-size distribution before the classification process, but 14.8% in the particle-size distribution after the classification process. The MgO crystal powder of particle diameter 1.0 μm or greater is 50% in the particle-size distribution before the classification process, but 70% in the particle-size distribution after the classification process.

A desirable MgO crystal used for forming the crystalline MgO layer 5 has particle-size distribution in which the crystal powder of particle diameter 0.7 μm or less is 25% or less and the crystal powder of particle diameter 1.0 μm or greater is 55% or more.

For size classification of the MgO crystal powder, for example, a powder classifier is used.

The BET specific surface area (s) is measured by a nitrogen adsorption method. From the measured value, the particle diameter (DBET) of the MgO crystal forming the crystalline MgO layer 5 is calculated by the following equation.

$$DBET=A/s\times\rho,$$

where

A: shape count (A=6)

ρ: real density of magnesium.

Note that the preparation of the vapor-phase MgO single crystal is described in "Preparation of magnesia powder using a vapor phase method and its properties" ("Zairyou (Materials)" vol. 36, no. 410, pp. 1157-1161, the November 1987 issue), and the like.

The crystalline MgO layer 5 is formed by use of a spraying technique, electrostatic coating technique or the like to cause the MgO crystal to adhere to the face of the dielectric layer 3 or the like.

Further, the crystalline MgO layer 5 may be formed through application of a coating of a paste including powder of MgO crystal by use of a screen printing technique, an offset printing technique, a dispenser technique, an inkjet technique, a roll-coating technique or the like. Alternatively, for forming the crystalline MgO layer 5, a coating of a paste including an MgO crystal may be applied onto a support film and then dried to a film, and then this film may be laminated on the thin-film MgO layer.

The MgO crystal contributes to an improvement in discharge characteristics, such as a reduction in discharge delay, as described later.

As compared with the case of magnesium oxide obtained by another method, particularly, the vapor-phase MgO single crystal has the features of being of a high purity, taking a fine-particle form, causing less particle aggregation, and the like.

In the above-mentioned PDP, a reset discharge, an address discharge and a sustaining discharge for generating an image are produced in the discharge cell C.

When the reset discharge, which is produced before the address discharge, is initiated in the discharge cell C, the priming effect caused by the reset discharge is maintained for a long duration by forming the crystalline MgO layer 5 in the discharge cell C, leading to fast response of the address discharge.

Figure 9:
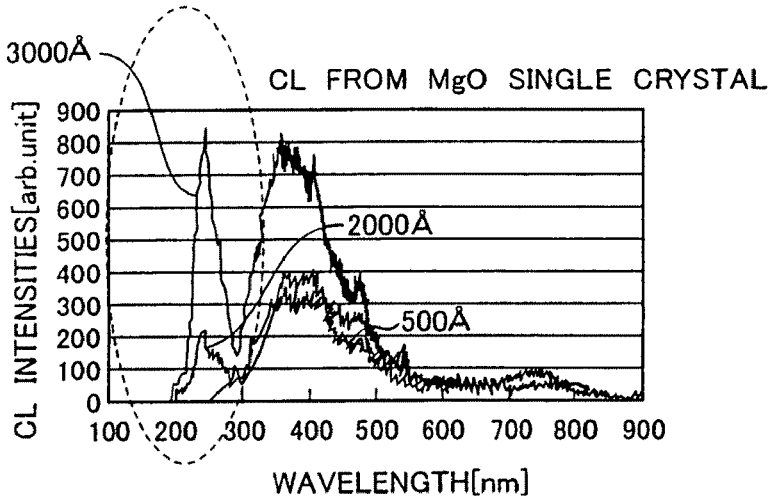
FIG. 9 is a graph showing the relationship between the particle diameter of a magnesium oxide single crystal and the wavelengths of CL emission in the embodiment.
Figure 10:
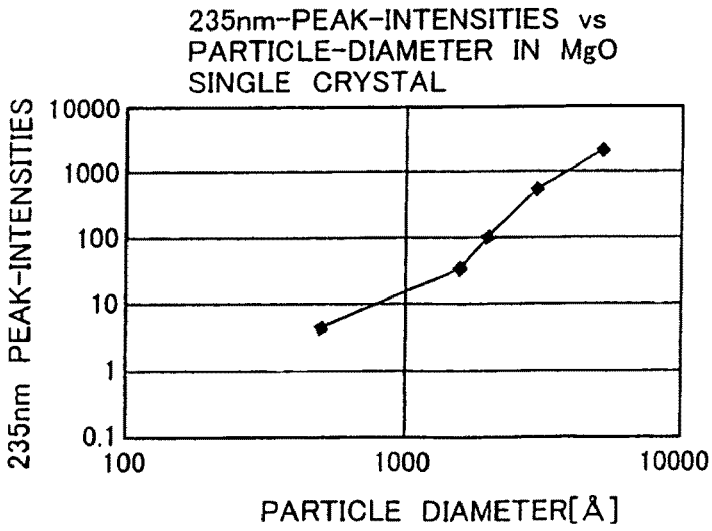
FIG. 10 is a graph showing the relationship between the particle diameter of a magnesium oxide single crystal and the intensities of CL emission at 235 nm in the embodiment.

Because the crystalline MgO layer 5 is formed of, for example, the vapor-phase MgO single crystal as described earlier, in the PDP the application of electron beam initiated by the discharge excites a CL emission having a peak within a wavelength range from 200 nm to 300 nm (particularly, from 230 nm to 250 nm, around 235 nm), in addition to a CL emission having a peak wavelength from 300 nm to 400 nm, from the large-particle-diameter vapor-phase MgO single crystal included in the crystalline MgO layer 5, as shown in FIGS. 9 and 10.

Figure 11:
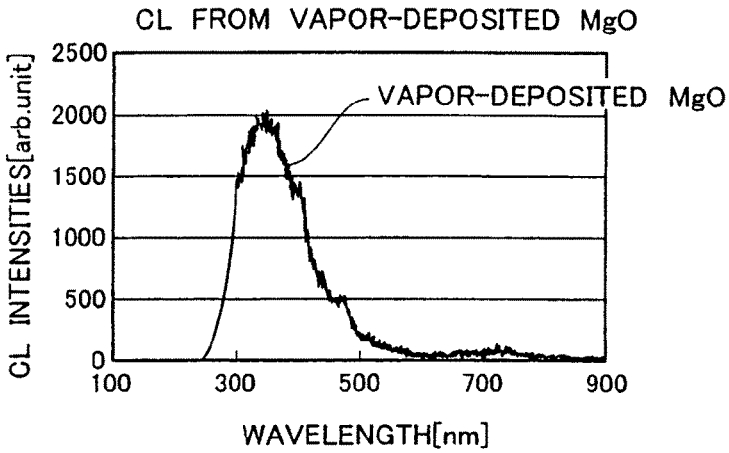
FIG. 11 is a graph showing the state of the wavelength of CL emission from the magnesium oxide layer formed by vapor deposition.

As shown in FIG. 11, the CL emission with a peak wavelength of 235 nm is not excited from a MgO layer formed typically by vapor deposition (the thin-film MgO layer 4 in the embodiment), but only a CL emission having a peak wavelength between 300 nm and 400 nm is excited.

As seen from FIGS. 9 and 10, the greater the particle diameter of the vapor-phase MgO single crystal, the stronger the peak intensity of the CL emission having a peak within the wavelength range from 200 nm to 300 nm (particularly, from 230 nm to 250 nm, around 235 nm).

It is conjectured that the presence of the CL emission having the peak wavelength between 200 nm and 300 nm will bring about a further improvement of the discharge characteristics (a reduction in discharge delay, an increase in the discharge probability).

More specifically, the conjectured reason that the crystalline MgO layer 5 causes the improvement of the discharge characteristics is because the vapor-phase MgO single crystal causing the CL emission having a peak within the wavelength range from 200 nm to 300 nm (particularly, from 230 nm to 250 nm, around 235 nm) has an energy level corresponding to the peak wavelength, so that the energy level enables the trapping of electrons for long time (some msec. or more), and the trapped electrons are extracted by an electric field so as to serve as the primary electrons required for starting a discharge.

Also, because of the co-relationship between the intensity of the CL emission and the particle diameter of the vapor-phase MgO single crystal, the stronger the intensity of the CL emission having a peak within the wavelength range from 200 nm to 300 nm (particularly, from 230 nm to 250 nm, around 235 nm), the greater the effect of improving the discharge characteristics caused by the vapor-phase MgO single crystal.

In other words, in order to form a vapor-phase MgO single crystal of a large particle diameter, an increase in the heating temperature for generating magnesium vapor is required. Because of this, the length of flame with which magnesium and oxygen react increases, and therefore the temperature difference between the flame and the surrounding ambience increases. Thus, it is conceivable that the larger the particle diameter of the vapor-phase MgO single crystal, the greater the number of energy levels occurring in correspondence with the peak wavelengths (e.g. within a range from 230 nm to 250 nm, around 235 nm) of the CL emission as described earlier.

It is further conjectured that regarding a vapor-phase MgO single crystal of a cubic polycrystal structure, many plane defects occur, and the presence of energy levels arising from these plane defects contributes to an improvement in discharge probability.

Figure 12:
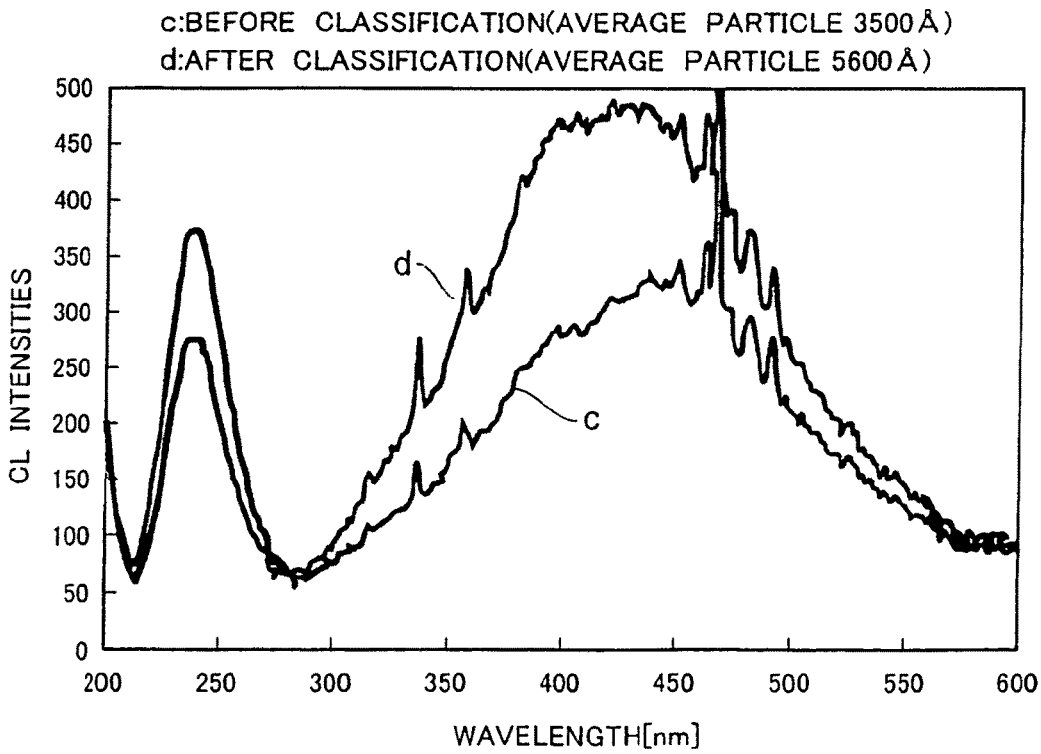
FIG. 12 is a graph showing the comparison of CL intensities between the classified and unclassified magnesium oxide crystals.

FIG. 12 is a graph showing the comparison of the CL intensities between the case of the MgO crystal powder being classified and the case of the MgO crystal powder being unclassified.

In FIG. 12, the graph c shows the peak intensities of a CL emission excited by the application of electron beam from MgO crystal powder of an average particle diameter of 3,500 angstroms before classification. The graph d shows the peak intensities of a CL emission excited from MgO crystal powder of an average particle diameter of 5,600 angstroms after classification.

Figure 13:
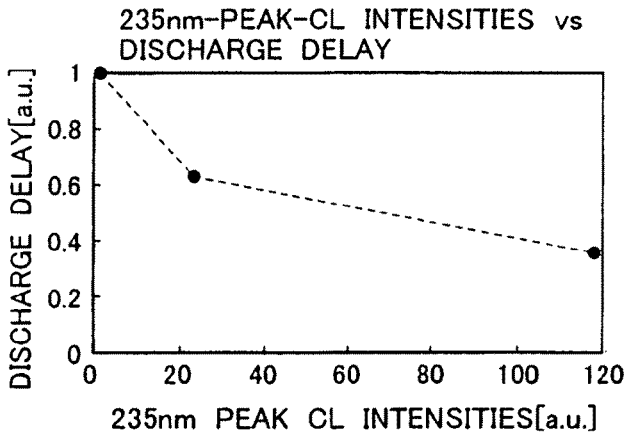
FIG. 13 is a graph showing the relationship between the discharge delay and the peak intensities of CL emission at 235 nm from the magnesium oxide single crystal.

It is seen from FIG. 12 that the classification of the MgO crystal powder increases the peak intensity of the CL emission by 1.5 times. FIG. 13 is a graph showing the co-relationship between the CL emission intensities and the discharge delay.

It is seen from FIG. 13 that the display delay in the PDP is shortened by the 235-nm CL emission excited from the crystalline MgO layer 5, and further as the intensity of the 235-nm CL emission increases, the discharge delay time is shortened.

For these reasons, the PDP having the crystalline MgO layer 5 that is formed of the powder of MgO crystal having predetermined particle-size distribution in which small-diameter crystal powder is removed by the classification process is significantly improved in the discharge delay.

The following is the reason that the classification of the MgO crystal powder causes the significant improvement of the discharge delay of the PDP.

MgO crystal powder includes particles that do not cause the CL emission having a peak wavelength around 235 nm, at a certain ratio. Hence, when the crystalline MgO layer is formed of the unclassified MgO crystal powder, a region in which a number of particles causing no CL emission having a peak wavelength around 235 nm are in existence is formed in the formed crystalline MgO layer, resulting in variations in the lengths of the discharge delays on the panel screen.

Performing the classification process allows the removal of the particles that do not cause CL emission having a peak wavelength around 235 nm from the MgO crystal powder. Thus, a crystalline MgO layer is formed uniformly along the panel surface by the MgO crystal causing CL emission having a peak wavelength around 235 nm. Because of this, the range of variation in the discharge delay on the panel surface is made narrow, resulting in a significant improvement of the discharge delay of the PDP.

Further, in the classified MgO crystal powder, a particle-size distribution ratio of large-particle-diameter crystal is high. Accordingly, when the crystalline MgO layer is formed of the classified MgO crystal powder, the required amount of MgO crystal powder is small as compared with the case of the crystalline MgO layer formed of the unclassified MgO crystal powder. In consequence, the transmittancy of visible light generated in the discharge cells is increased, resulting in an improvement in the luminous efficiency.

Further, because in the classified MgO crystal powder, the particle-size distribution ratio of the large-particle-diameter crystal is high, the total surface area of the crystal powder forming the crystalline MgO layer is reduced (for example, the total BET surface area is 5.6 $m^2/g$ when the crystalline MgO layer is formed of the unclassified crystal powder of a particle diameter of 3,000 angstroms, but the total BET surface area is 3.0 $m^2/g$ which is about one-half that, when the crystalline MgO layer is formed of the classified crystal powder of a particle diameter of 5,600 angstroms). This reduction leads to a relative reduction in the degree of adsorption of the discharge gas, resulting in an increase in the reliability of the PDP offered by forming the crystalline MgO layer of the classified MgO crystal powder.

Figure 14:
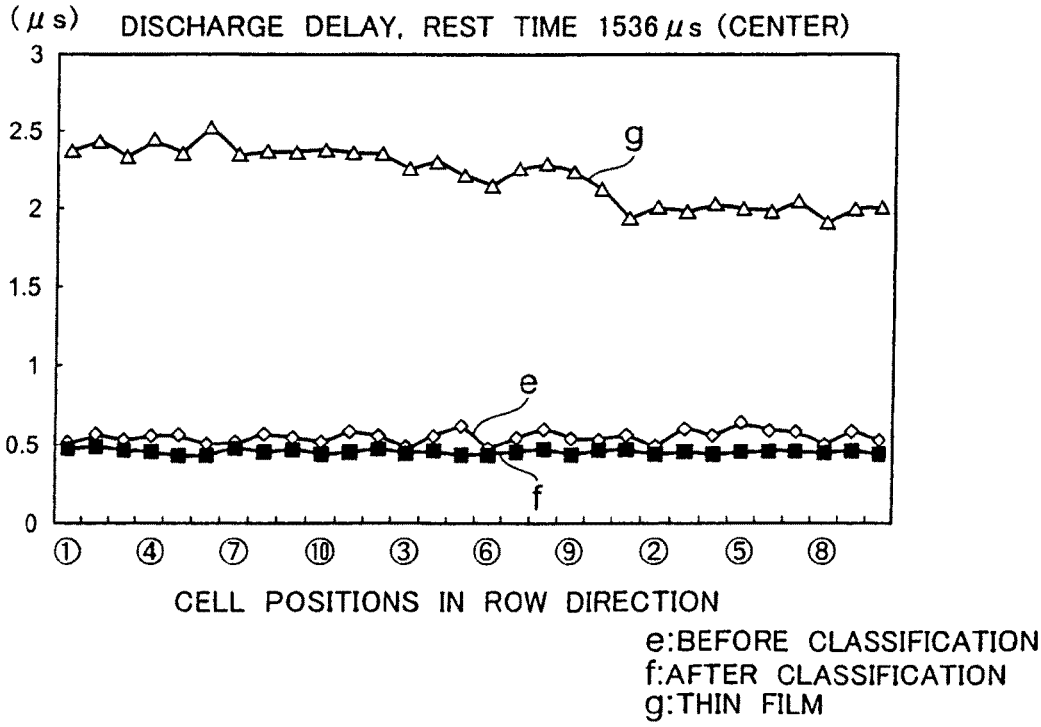
FIG. 14 is a graph showing the comparison of variations of discharge delay.

FIG. 14 is a graph showing variations in discharge delay in the panel surface of the PDP in the case of the crystalline MgO layer being formed of MgO crystal powder before classification (graph e), the case of the crystalline MgO layer being formed of MgO crystal powder after classification (graph f), and the case of the thin-film MgO layer alone being formed (graph g).

The horizontal axis of the graph in FIG. 14 shows cell positions in the row direction in the panel surface.

As seen from FIG. 14, by providing the crystalline MgO layer formed of the MgO crystal, the discharge delay in the PDP is reduced to about one-fifth as compared with the case of only the thin-film MgO layer being formed. Further, by performing the classification process on the MgO crystal powder forming the crystalline MgO layer, the discharge delay is further improved and the range of variations in the discharge delays on the panel surface is made narrow, as compared with the case of using the unclassified MgO crystal powder.

In FIG. 14, the variations (a) in discharge delay is $\sigma$=0.181 μs when the thin-film MgO layer alone is formed in the PDP, $\sigma$=0.041 μs when the crystalline MgO layer formed of the unclassified MgO crystal powder is provided, and $\sigma$=0.015 μps when the crystalline MgO layer formed of the classified MgO crystal powder is provided.

Figure 15:
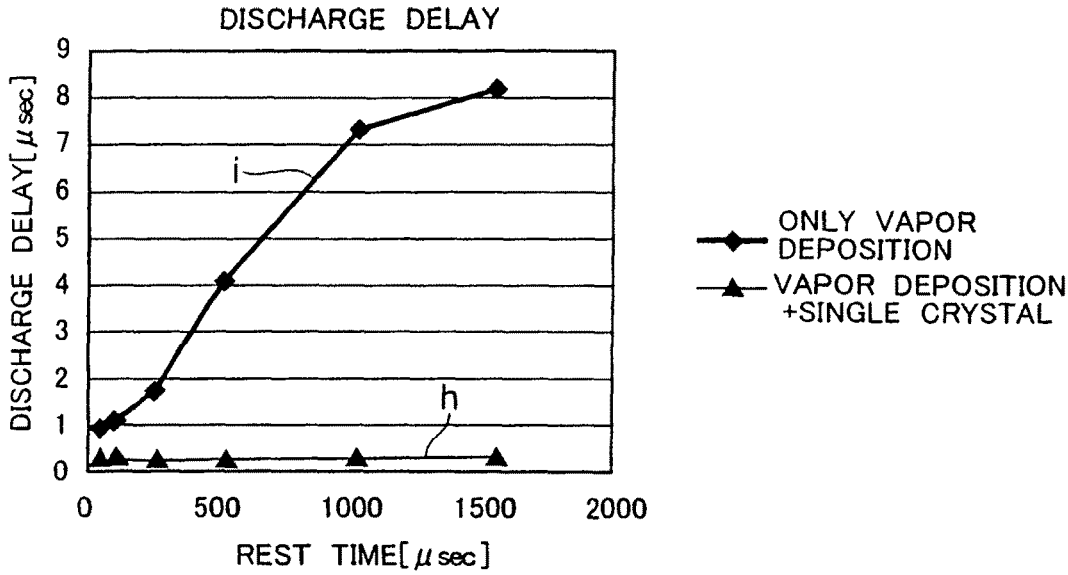
FIG. 15 is a graph showing the comparison of the discharge delay characteristics between the case when the protective layer is constituted only of the magnesium oxide layer formed by vapor deposition and that when the protective layer has a double layer structure made up of a crystalline magnesium layer and a thin film magnesium layer formed by vapor deposition.

FIG. 15 is a graph showing the comparison of the discharge delay characteristics between the case when the PDP is provided with a double layer structure made up of a thin-film MgO layer 4 and a crystalline MgO layer 5 as described in the structure of FIGS. 1 to 3 (graph h) and that when only a magnesium oxide layer formed by vapor deposition is formed as in conventional PDPs (graph i).

As seen from FIG. 15, the PDP according to present invention is significantly improved in the discharge delay characteristics by being provided with the double-layer structure made up of the thin-film MgO layer 4 and the crystalline MgO layer 5 as compared with that of a conventional PDP having only a thin-film MgO layer formed by vapor deposition.

As described hitherto, in the PDP of the present invention, MgO crystal powder that causes a CL emission having a peak within a wavelength range from 200 nm to 300 nm upon excitation by an electron beam is classified, whereby the MgO crystal powder has particle-size distribution in which a crystal of equal to or larger than predetermined particle diameter is included at a predetermined ratio or more by volume. This MgO crystal powder is used for forming a crystalline MgO layer 5. The crystalline MgO layer 5 is laminated on a conventional thin-film MgO layer 4 formed by vapor deposition or the like. Thereby, the discharge characteristics such as relating to discharge delay are significantly improved, so that the PDP of the present invention is capable of having satisfactory discharge characteristics. Further, the occurrence of variations in discharge delays on the panel surface is reduced, so that the PDP is improved in luminous efficiency.

There is not necessarily a need to form the crystalline MgO layer 5 covering the entire rear-facing face of the thin-film MgO layer 4 as described earlier. For example, the crystalline MgO layers 5 may be formed partially in areas opposite the transparent electrodes Xa, Ya of the row electrodes X, Y or alternatively areas not opposite the transparent electrodes Xa, Ya, through a patterning process.

In the case of partially forming the crystalline MgO layers 5, the area ratio of the crystalline MgO layer 5 to the thin-film MgO layer 4 is set in a range from 0.1% to 85%, for example.

Figure 16:
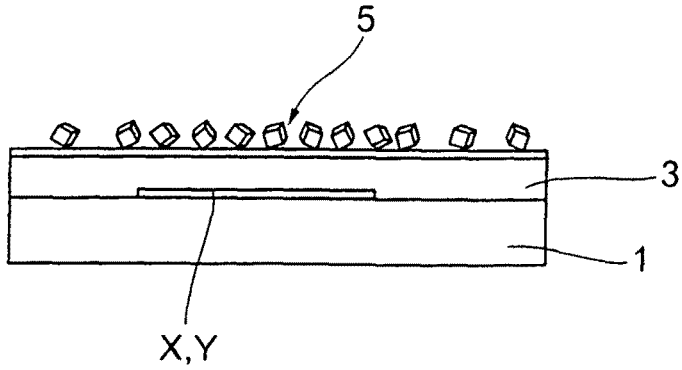
FIG. 16 is a sectional view illustrating the state of the crystalline magnesium layer formed as a single layer.

Further, the foregoing has described the example of the PDP having the double layer structure made up of the thin-film MgO layer 4 and the crystalline MgO layer 5 laminated thereon. However, the single-crystalline MgO layer 5 alone may be formed as a single layer on the dielectric layer 3 as illustrated in FIG. 16.

Figure 17:
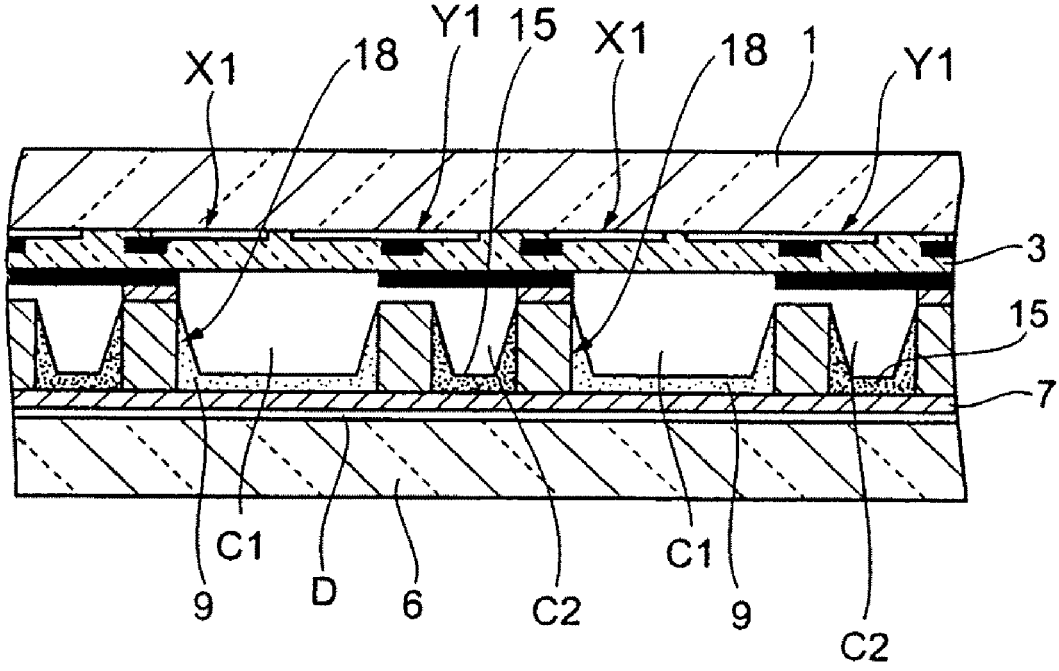
FIG. 17 is a sectional view showing an example of the crystalline magnesium oxide layer being formed in an address discharge cell.

The above has described the example of the PDP having the crystalline MgO layer 5 formed on the dielectric layer 3 . However, as illustrated in FIG. 17, a discharge cell may be divided into two discharge areas: a display discharge cell C1 providing for a sustain discharge produced for light emission and an address discharge cell C2 providing for an address discharge produced for selecting the display discharge cells C1 for light emission. In a PDP having the above cell structure, a crystalline MgO layer 15 formed of classified MgO crystal powder as in the aforementioned case is provided in each of the address discharge cells C2.

In this case, a paste including MgO crystal powder is used to form the crystalline MgO layer 15 in the address discharge cell C2 by a screen printing technique, a dispenser technique or the like.

Note that, in FIG. 17, reference symbols X1 and Y1 denote row electrodes and reference numeral 18 denotes a partition wall unit for defining the discharge cells and for partitioning each of the discharge cells into two areas: the display discharge cell C1 and the address discharge cell C2. The other structural components in FIG. 17, which are the same as those in the PDP shown in FIGS. 1 to 3, are designated with the same reference numerals.

The foregoing has described the example when the present invention applies to a reflection type AC PDP having the front glass substrate on which row electrode pairs are formed and covered with a dielectric layer and the back glass substrate on which phosphor layers and column electrodes are formed. However, the present invention is applicable to various types of PDPs, such as a reflection-type AC PDP having row electrode pairs and column electrodes formed on the front glass substrate and covered with a dielectric layer, and having phosphor layers formed on the back glass substrate; a transmission-type AC PDP having phosphor layers formed on the front glass substrate, and row electrode pairs and column electrodes formed on the back glass substrate and covered with a dielectric layer; a three-electrode AC PDP having discharge cells formed in the discharge space in positions corresponding to the intersections between row electrode pairs and column electrodes; a two-electrode AC PDP having discharge cells formed in the discharge space in positions corresponding to the intersections between row electrodes and column electrodes.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel comprising:

a front substrate and a back substrate facing each other to form a discharge space, wherein on a discharge space side of the front substrate there are disposed a metal oxide layer and magnesium oxide crystal particles, and wherein an area ratio of the magnesium oxide crystal particles to the metal oxide layer is 0.1% to 85%.

2. The plasma display panel according to claim 1, wherein the magnesium oxide crystal particles are arranged to be protruding closer to a discharge space than the surface of the metal oxide layer.

3. The plasma display panel according to claim 1, wherein the magnesium oxide crystal particles are arranged on a discharge space side of the metal oxide layer, or alternatively, part of the magnesium oxide crystal particles are disposed within the metal oxide layer.

4. The plasma display panel according to claim 1, wherein the front substrate is configured to perform an emission having a peak within a wavelength range of 200 nm to 300 nm upon excitation by an energy source.

5. A plasma display panel comprising a front substrate and a back substrate facing each other to form a discharge space, wherein:

on a discharge space side of the front substrate there are disposed a metal oxide layer and magnesium oxide crystal particles, the magnesium oxide crystal particles and the metal, oxide layer directly face the discharge space, and an area ratio of the magnesium oxide crystal particles to the metal oxide layer is 0.1% to 85%.

6. The plasma display panel according to claim 5, wherein the magnesium oxide crystal particles are arranged to be protruding closer to the discharge space than a surface of the metal oxide layer.

7. The plasma display panel according to claim 5, wherein the magnesium oxide crystal particles are arranged on a discharge space side of the metal oxide layer, or alternatively, part of the magnesium oxide crystal particles are disposed within the metal oxide layer.

8. The plasma display panel according to claim 5, wherein the front substrate is configured to have an emission having a peak within a wavelength range of 200 nm to 300 nm upon excitation by an energy source.

9. The plasma display panel according to claim 5, wherein the magnesium oxide crystal particles are spaced apart from each other.

* * * * *